US011161532B2

(12) United States Patent
Smith et al.

(10) Patent No.: US 11,161,532 B2
(45) Date of Patent: Nov. 2, 2021

(54) MONITORING SYSTEM, WAYSIDE LED SIGNAL, AND METHOD FOR MONITORING A WAYSIDE LED SIGNAL

(71) Applicant: SIEMENS MOBILITY, INC., New York, NY (US)

(72) Inventors: Jeffrey Smith, Chippenham (GB); David Cowen, Chippenham (GB)

(73) Assignee: Siemens Mobility, Inc., New York, NY (US)

( * ) Notice: Subject to any disclaimer, the term of this patent is extended or adjusted under 35 U.S.C. 154(b) by 390 days.

(21) Appl. No.: 16/310,270

(22) PCT Filed: Jun. 27, 2016

(86) PCT No.: PCT/US2016/039551

§ 371 (c)(1),
(2) Date: Dec. 14, 2018

(87) PCT Pub. No.: WO2018/004513

PCT Pub. Date: Jan. 4, 2018

(65) Prior Publication Data

US 2019/0185034 A1 Jun. 20, 2019

(51) Int. Cl.
*B61L 5/18* (2006.01)
*B61L 1/02* (2006.01)
(Continued)

(52) U.S. Cl.
CPC ..... *B61L 5/18* (2013.01); *B61L 1/02* (2013.01); *B61L 1/181* (2013.01); *B61L 5/1881* (2013.01); *B61L 1/20* (2013.01); *B61L 2207/02* (2013.01)

(58) Field of Classification Search
CPC .... B61L 1/02; B61L 1/18; B61L 1/181; B61L 1/188; B61L 1/20; B61L 5/00; B61L 5/18
See application file for complete search history.

(56) References Cited

U.S. PATENT DOCUMENTS

2016/0347336 A1 12/2016 Pless et al.

FOREIGN PATENT DOCUMENTS

EP 2488401 A1 * 8/2012 ..... B61L 5/1881
EP 2488401 B1 8/2013
(Continued)

OTHER PUBLICATIONS

PCT International Search Report and Written Opinion of International Searching Authority dated Mar. 24, 2017 corresponding to PCT International Application No. PCT/US2016/039551 filed Jun. 27, 2016.

*Primary Examiner* — Robert J McCarry, Jr.

(57) ABSTRACT

A monitoring system for a light emitting diode (LED) signal (100) includes optical detectors (120) for measuring a light output of LEDs (112, 114), a first processing unit (124) in communication with the plurality of optical detectors (120) and configured to receive and process measurement data of the light output from the plurality of optical detectors (120), and a first switching element (130) operably coupled to the first processing unit (124). The first processing unit (124) is further configured to transmit a control signal based on the measurement data of the light output of the plurality of LEDs (112, 114) to the first switching element (130) to disconnect a reference load (150) by switching from a first state to a second state when the light output is less than a predefined threshold value, wherein the second state of the first switching element (130) is stored in a storage medium (148).

17 Claims, 2 Drawing Sheets

(51) Int. Cl.
*B61L 1/18* (2006.01)
*B61L 1/20* (2006.01)

(56) References Cited

FOREIGN PATENT DOCUMENTS

| | | | | |
|---|---|---|---|---|
| WO | 9849872 | A1 | 11/1998 | |
| WO | 2015073954 | A1 | 5/2015 | |
| WO | WO-2015073954 | A1 * | 5/2015 | ..... B61L 5/1854 |

* cited by examiner

MONITORING SYSTEM, WAYSIDE LED SIGNAL, AND METHOD FOR MONITORING A WAYSIDE LED SIGNAL

CROSS REFERENCE TO RELATED APPLICATIONS

This Application is the U.S. National Stage of International Application No. PCT/US2016/039551 filed 27 Jun. 2016 and claims benefit thereof, the entire content of which is hereby incorporated herein by reference.

BACKGROUND

1. Field

Aspects of the present invention generally relate to a monitoring system, a wayside light emitting diode (LED) signal, and a method for monitoring a wayside LED signal.

2. Description of the Related Art

The railroad industry employs wayside signals to inform train operators of various types of operational parameters. For example, colored wayside signal lights are often used to inform a train operator as to whether and how a train may enter a block of track associated with the wayside signal light. The status/color of wayside signal lamps is sometimes referred to in the art as the signal aspect. One simple example is a three color system known in the industry as Automatic Block Signaling (ABS), in which a red signal indicates that the block associated with the signal is occupied, a yellow signal indicates that the block associated with the signal is not occupied but the next block is occupied, and green indicates that both the block associated with the signal and the next block are unoccupied. It should be understood, however, that there are many different kinds of signaling systems. Other uses of signal lights to provide wayside status information include lights that indicate switch position, hazard detector status (e.g., broken rail detector, avalanche detector, bridge misalignment, grade crossing warning, etc.), search light mechanism position, among others.

Wayside signal lights are coupled to and controlled by a railway interlocking, also referred to as interlocking system or IXL, which is a safety-critical distributed system used to manage train routes and related signals in a station or line section, i.e. blocks of tracks. There are different interlocking types, for example vital relay-based systems or vital processor-based systems that are available from a wide variety of manufacturers.

Existing wayside signal lights can include incandescent bulbs or light emitting diodes (LEDs). The benefits of wayside LED signals are improved visibility, higher reliability and lower power consumption.

The interlocking system permits hot and cold filament checks in order to detect lamp malfunction. While the terms 'hot and cold filament checks' originated with incandescent bulbs, the underlying concepts apply equally well to LED lighting. Hot-filament checking implies verifying that sufficient visible light is being emitted when the appropriate input is provided to the signal head. Cold filament checking proves that the filament of an incandescent lamp is intact, or that an LED signal is connected. This provides advance knowledge of a lamp failure so that the preceding aspects can be downgraded in advance, thus preventing a sudden unexpected downgrade.

The American Railway Engineering and Maintenance-of-Way Association (AREMA) defines hot filament testing for LED signals as a verification that 50% of the individual LEDs installed within the wayside signal are operating. The interlocking system performs hot filament testing by monitoring current drawn by the wayside signal; however, monitoring of a load does not necessarily give a true indication of light emitted from the signal. Modern LEDs emit light at high intensity with considerably less input power than incandescent bulbs, so most LED signals on the market emulate incandescent lamps by wasting power in dummy loads. The failure of several LEDs in the wayside signal does not necessarily change the current of the load significantly to allow detection of a failure by the interlocking. Additionally, light output of LEDs decreases as the devices age, meaning that the load seen by the interlocking from the LED signal as it ages will remain constant but the light output may eventually drop to a level below a minimum specification. Thus, there is a need for a wayside LED signal including a system that monitors intensity of the light output and disconnects the load and the LED signal permanently when it falls below a specified level.

SUMMARY

Briefly described, aspects of the present invention relate to a monitoring system, a wayside LED signal, and a method for monitoring a wayside LED signal. In particular, the LED signal is configured as a railroad wayside signal for installing along railroad tracks. One of ordinary skill in the art appreciates that such a LED signal can be configured to be installed in different environments where signals and signaling devices may be used, for example in road traffic.

A first aspect of the present invention provides a monitoring system for light out detection for a LED signal comprising a plurality of optical detectors for measuring a light output of a plurality of LEDs; a first processing unit in communication with the plurality of optical detectors and configured to receive and process measurement data of the light output from the plurality of optical detectors; and a first switching element operably coupled to the first processing unit, wherein the first processing unit is further configured to transmit a control signal based on the measurement data of the light output of the plurality of LEDs to the first switching element to disconnect a reference load by switching from a first state to a second state when the light output is less than a predefined threshold value, and wherein the second state of the first switching element is stored in a storage medium.

A second aspect of the present invention provides a LED signal comprising an arrangement of multiple LEDs and multiple LED driver units for driving the multiple LEDs; and a monitoring system comprising multiple optical detectors arranged to detect and monitor light output of the multiple LEDs, at least one processing unit configured to receive and process measurement data of the multiple optical detectors, and at least one switching element coupled to the at least one processing unit, wherein the first processing unit is further configured to transmit a control signal based on the measurement data of the light output to the first switching element to disconnect a reference load by switching from a first state to a second state when the light output of the multiple LEDs is less than a predefined threshold value, and wherein the second state of the first switching element is stored in a non-volatile storage medium.

A third aspect of the present invention provides a method for monitoring a light output of a LED signal comprising measuring light output of multiple LEDs by multiple optical detectors installed in the LED signal; disconnecting a reference load from the LED signal when the light output of the multiple LEDs falls below a predefined threshold value by a first switching element; and storing a state of the first switching element after the disconnecting of the reference load in a storage medium.

DETAILED DESCRIPTION

To facilitate an understanding of embodiments, principles, and features of the present invention, they are explained hereinafter with reference to implementation in illustrative embodiments. In particular, they are described in the context of being a monitoring system, a wayside LED signal and a method for monitoring a wayside LED signal. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Wayside railroad signal display aspects provide the only means of authority for train movements in many control systems. In other control systems, the displayed aspect is important to ensure safe train separation. In all implementations, failure to display the desired aspect has a potential safety implication. To achieve safe railroad operations, the system should have a reliable method for determining that a signal aspect intended for display by the control system is, in fact, being displayed. Such a method may be referred to as light out detection. Light out detection is for example used for downgrading approach lights in the event of a signaling lamp failure.

Figure 1:
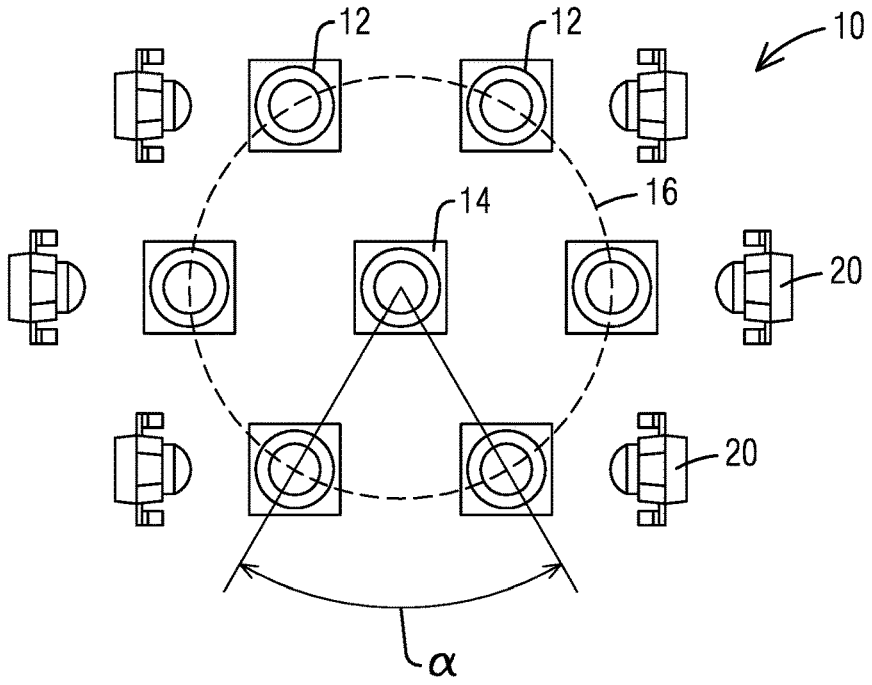
FIG. 1 illustrates a basic schematic of arrangements of LEDs and optical detectors for a wayside signal in accordance with an exemplary embodiment of the present invention.

FIG. 1 illustrates a basic schematic of an arrangement 10 of LEDs 12, 14 for a wayside signal in accordance with an exemplary embodiment of the present invention. Wayside signaling is moving away from incandescent lighting to LED lighting because LED signals, herein also referred to as LED signaling devices, have improved visibility, higher reliability and lower power consumption. According to the embodiment of FIG. 1, the arrangement 10 comprises a plurality of LEDs 12, 14, in particular one center LED 14 and multiple outer LEDs 12. The outer LEDs 12 include six LEDs 12 arranged around the center LED 14 and along circle 16 with equal distances to each other. Such a configuration may also be referred to as hexapolar configuration. Angles $\alpha$ between the circularly arranged LEDs 12 are each 60°, measured from a center of the circle 16, which coincides with the location of the center LED 14.

FIG. 1 further illustrates an arrangement of a plurality of optical detectors 20. For example, the arrangement can comprise six optical detectors 20, wherein the six optical detectors 20 are assigned to the six outer circularly arranged LEDs 12. Specifically, one optical detector 20 is assigned to one LED 12, thus providing a single LED output control for each outer LED 12. Each optical detector 20 is arranged such that it detects light output from the closest LED 12. As FIG. 1 shows, the center LED 14 is not monitored by an optical detector 20. The optical detectors 20 can be for example photodiodes or phototransistors, in particular side-looking photodiodes. It should be noted that the described arrangements of LEDs 12, 14 and optical detectors 20 are only exemplary, and that many other numbers and/or arrangements of LEDs and optical detectors, for example two LEDs with two optical detectors or six LEDs (two rows of three LEDs) with six optical detectors, are possible.

Figure 2:
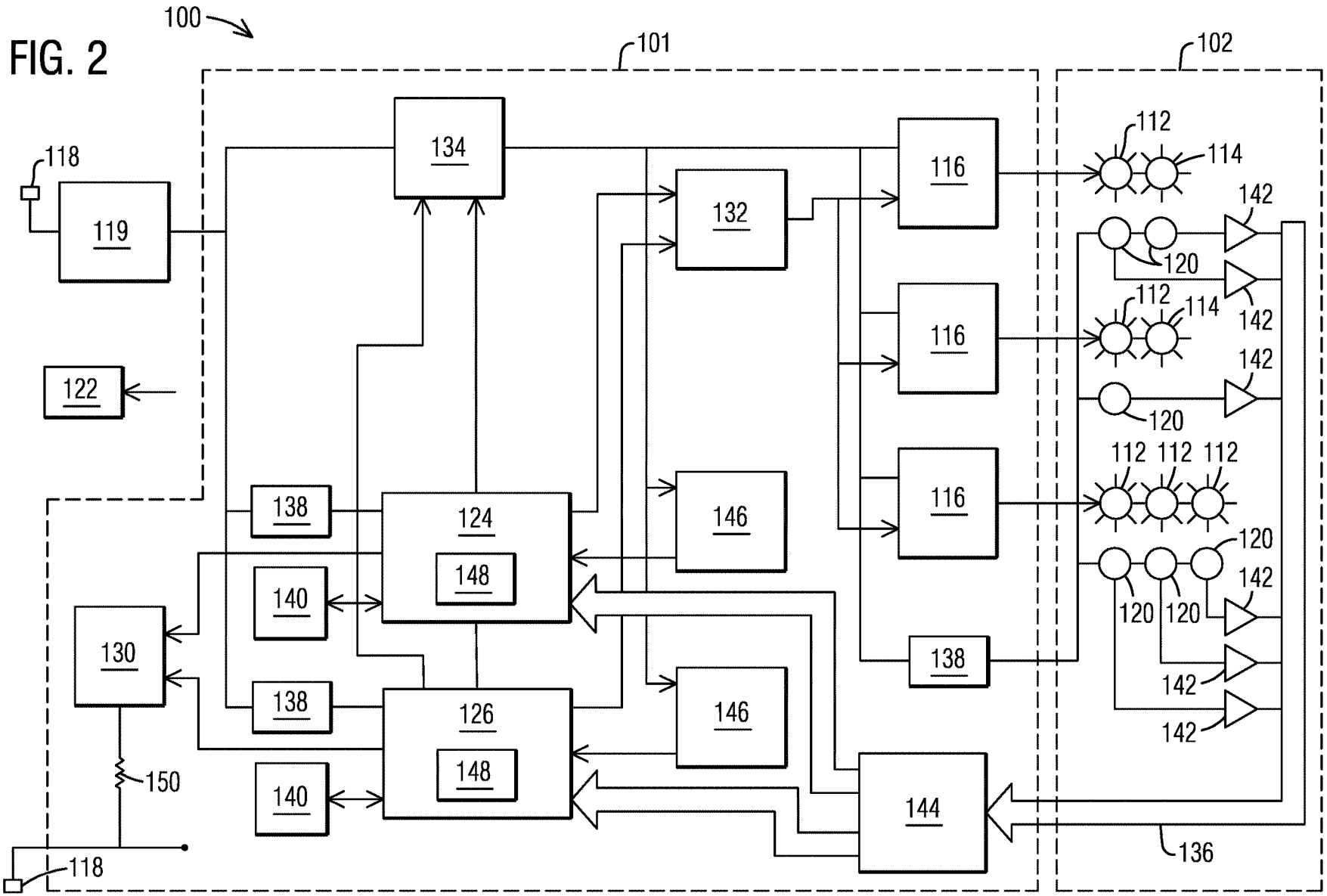
FIG. 2 illustrates a schematic of a wayside LED signal comprising a monitoring system for light out detection in accordance with an exemplary embodiment of the present invention.

FIG. 2 illustrates a schematic of a wayside LED signal 100 comprising a monitoring system for light out detection in accordance with an exemplary embodiment of the present invention. The LED signal 100 comprises an LED arrangement with a plurality of LEDs 112, 114 which can be arranged as described for example in FIG. 1.

Multiple LED driver units 116 are operably coupled to the LEDs 112, 114 for driving the LEDs 112, 114. In particular, three LED driver units 116 drive the LEDs 112, 114, wherein two LED driver units 116 drive two LEDs 112, 114, respectively, and one driver unit 116 drives three LEDs 112. Of course there can be more or less than three LED driver units 116 depending on configurations and/or types of LEDs and/or driver unit(s).

The LEDs 112, 114 and LED driver units 116, herein also generally referred to as LED circuit, are coupled to a power source 118, for example a current source, more specifically a direct current (DC) source, including input protection 119.

The LED circuit comprising LEDs 112, 114 and LED driver units 116 is coupled to and controlled by a railway interlocking 122. As described before, the interlocking 122 is a safety-critical distributed system used to manage train routes and related signals in a station or line section, i.e. blocks of tracks. There are different interlocking types, for example vital relay-based systems or vital processor-based systems. In an exemplary embodiment, the interlocking 122 is configured as processor-based system. It should be noted that the interlocking 122 and the power source 118 comprise the same ports. In other words, the interlocking 122 is the power source 118 of the LED signal 100, and the LED signal 100 only has one interface to the interlocking 122 (power source 118).

As described before, when operating the LED signal 100, one of the basic hazards to be mitigated is that, where light out detection is used, the wayside LED signal 100 must not indicate that light is being generated when less than 50% of the rated light output is being generated. The LED signal 100 as described herein is configured and operated in accordance with this standard.

In parallel to the LED circuit, an optical output control circuit, herein also referred to as monitoring system, is provided, which comprises optical detectors and further components required for monitoring and controlling light output of the LEDs 112, 114. The wayside signal 100 comprises a plurality of optical detectors 120, embodied for example as photodiodes or phototransistors, used for sensing/measuring light output of the LEDs 112, 114. The optical detectors 120 can be arranged for example as described in FIG. 1.

The optical detectors 120 are in communication with at least a first processing unit 124. According to the example illustrated in FIG. 2, the optical detectors 120 are in communication with a first processing unit 124 and a second processing unit 126, respectively. The processing units 124, 126 are arranged in parallel. The first and second processing units 124, 126 are each a suitable processing device such as, and without limitation, a microcontroller, a microprocessor, a programmable logic controller (PLC), or a field programmable gate array (FPGA). The processing units 124, 126 comprise inputs and outputs, wherein devices for programming and/or diagnosing the processing units 124, 126 can be connected to the processing units 124, 126 via ports 140. The processing units 124, 126 communicate with each other as indicated by arrow 128. The processing units 124, 126 comprise similar logic and functionalities and may be considered redundant to achieve safety critical operation, in particular 2-out-of-2 operation which will be explained later.

The processing units 124, 126, and the optical detectors 120 are connected to the power source 118 (interlocking 122) which provides power for operating the processing units 124, 126, and the optical detectors 120. DC/DC converters 138 can be coupled between the power source 118 and the processing units 124, 126 and optical detectors 120 so that the electronic components receive correct rated voltage. The power source 118 (interlocking 122) provides a common power source for the LED circuit as well as the monitoring system.

On output sides, the first and second processing units 124, 126 are coupled to a plurality of switching elements 130, 132, 134. A first switching element 130 is arranged across a power feed between the ports of the power source 118 (interlocking 122) for disconnecting (or connecting) a reference load 150 arranged across the power feed. A second switching element 132 is directly coupled between the processing units 124, 126 and the LED driver units 116 for disabling (or enabling) electronics of the LED driver units 116. A third switching element 134 is arranged between the power source 118 and the LED driver units 116 for disconnecting (or connecting) the power source 118 from the LED driver units 116.

The switching elements 130, 132, 134 are controlled by the first and second processing units 124, 126. The processing units 124, 126 provide two-out-of-two logic, herein also referred to as 2-out-of-2 or 2oo2 logic. One of ordinary skill in the art is familiar with 2oo2 logic. Briefly described, 2oo2 logic is a dual voted configuration where two votes are available. The votes are accomplished, for example, by taking sensor signals and comparing them in processing unit(s) executing application logic. Actuator signals are then directed to outputs where the signal for the actuator is either electrically or logically solved, or both. For 2oo2 logic, both sensor signals are required to be present for operation. For example, a system is only operating, when both sensor signals indicate that there are no defects or failures within the system. Consequently, the system is shutdown when either sensor signal path indicates failure. 2oo2 voting logic provides a SIL 4 (Safety Integrity Level 4) rating which is the most dependable standard of safety integrity levels.

According to an embodiment of the present invention, 2oo2 logic is used for a light out decision, i.e. disconnect or shutdown of the LED signal 100, based on measurements of the optical detectors 120. The switching elements 130, 132, 134 are configured as 2oo2 switching elements able to process signals of both processing units 124, 126. Signals from both processing units 124, 126 are required for a proper operation of the LED signal 100. If one of the processing units 124, 126 detects an issue, the LED signal 100 will be disconnected or shutdown. This means that only a signal of one of the processing units 124 or 126 is required for a switch of the switching elements 130, 132, 134 from a first state into a second state and thereby disconnecting the reference load 150 and/or disabling electronics of the LED driver units 116.

As described before, the optical detectors 120 are configured as photodiodes or phototransistors, converting optical signals (light) into electric signals (current). The processing units 124, 126 are each configured to receive and process measurement data from the optical detectors 120. Specifically, the processing units 124, 126 each comprise means, for example computer readable instructions (software), for evaluating and processing electric signals generated by the optical detectors 120. The processing units 124, 126 process the measurement data, and transmit control signals to one or more of the switching elements, specifically switching elements 130, 132, to disconnect the reference load 150 and disable the LED driver units 116. If either processing unit 124 or 126 determines that the light output of the LEDs 112, 114 is less than 50% of the rated light output of the LEDs 112, 114, based on the measurements of the optical detectors 120, the switching elements 130, 132 trigger a shutdown of the LED signal 100. In other words, the switching element 130 disconnects the reference load 150 and the switching element 132 disables the LED driver units 116 when they each receive a control signal of either processing unit 124 or 126 to disconnect or disable. When the first switching element 130 disconnects the reference load 150, current drawn from the interlocking 122 (power source 118) drops to a very low level and it appears like an incandescent lamp has blown. The 2oo2 logic provided by the processing units 124, 126 in combination with the 2oo2 switching elements 130, 132 for a light out decision of the LED signal 100 based on the measurements of the optical detectors 120 provides a SIL 4 (Safety Integrity Level 4) rating which is the most dependable standard of safety integrity levels.

The plurality of optical detectors 120 can be directly operably connected to the processing units 124, 126. According to an exemplary embodiment as illustrated in FIG. 2, outputs of the optical detectors 120 can be coupled to amplifiers 142 for amplifying the generated electric signals, for example amplifying the current signal or obtaining a voltage signal. Further, the generated signals of the optical detectors 120 can be combined and a combined signal 136 be transmitted to the first and second processing units 124, 126, respectively, wherein a signal distribution unit 144 can distribute the signal 136. The processing units 124, 126 receive the same information from the optical detectors 120 via the signal 136.

According to an exemplary embodiment, a configuration of the monitoring system is such that when three of the monitored outer LEDs 112 fail, disconnect of the reference load 150 will occur. This configuration takes into account that the center LED 114 may also be failing. But since the center LED 114 is not monitored by an optical detector 120, it is unknown if the center LED 114 is working properly or not. The proposed configuration provides a monitoring system and a LED signal 100 meeting the requirement for disconnect at less than 50% light output of the rated light output of the LEDs 112, 114, because the light output falls below 50% of the rated light output when four of the seven LEDs 112, 114 fail.

In a further exemplary embodiment of the invention, light output status of the LED signal 100 is stored in a storage medium 148, specifically in a non-volatile storage medium. Such a storage medium is a computer storage medium which can comprise, but is not limited to, ROM, EEPROM, flash memory or other memory technology, CD-ROM, digital versatile disks (DVD) or other optical disk storage, magnetic cassettes, magnetic tape, magneto-optical storage devices, magnetic disk storage or other magnetic storage devices, or other media that can be used to store the desired information and may be accessed by the processing units 124, 126 and/or the interlocking 122.

The storage medium 148, herein also referred to as memory, can be integrated in one and/or both of the processing units 124, 126 or can be a separate memory. FIG. 2 illustrates that each processing unit 124, 126 comprises a storage medium 148. As described above, the LED signal 100 is disabled when the light output of the LEDs 112, 114 is less than 50% of the rated light output of the LEDs 112, 114. Such a light output status, specifically a light out state, is stored in the memory 148. Subsequent attempts by the interlocking 122 to turn on the failed LED signal 100 will result in the LED signal 100 immediately entering the light out state as the interlocking 122 reads the bits relating to the light out state on start-up. For example, the first and/or second processing unit(s) 124, 126 transmit control signal(s) based on the measurement data of the light output to the first switching element 130 to disconnect the reference load 150, wherein the switching element 130 switches from a first state to a second state when the light output is less than 50% of the rated light output. The first state of the switching element 130 can be considered a connect-state and the second state can be a disconnect state or a light out state. The second state, the light out state, of the switching element 130 is stored in the memory 148. The same can apply with regard to the second switching element 132 for disabling the electronics of the LED driver units 116. When disabling the electronics of the LED driver units 116, the second switching element 132 switches from a first state to a second state, wherein the second state (light out state) can be stored in one or more of the storage media 148.

FIG. 2 further illustrates voltage monitor interfaces 146 which can be used for monitoring voltage supplied by the power supply 118. Suitable devices for monitoring the supply voltage can be connected via the interfaces 146 to the processing units 124, 126. If the supply voltage is correct, a corresponding signal is sent to the processing units 124, 126. If the supply voltage provided by the power source 118 is not correct, a different signal is transmitted to the processing units 124, 126 which then trigger the 2oo2 switching device 134 to disconnect the power source 118. The 2oo2 switching device 134 disconnects the power source 118 when one of the processing units 124 or 126 determines that the supply voltage is not correct. Here, the processing units 124, 126 also provide 2oo2 logic as described before. The voltage supplied by the power source 118 can be monitored/tested at any time, for example is continually monitored. The monitoring system continually monitors light level/light output of the LED signal 100. Furthermore, self tests of the LED signal 100 can be conducted and can occur for example at power-up of the LED signal 100, wherein one or more of the switching elements 130, 132, 134 can be configured to disconnect or disable when a self test fails.

With further reference to FIG. 2, the LED signal 100 can comprise a control card 101 and a LED card 102. The LED card 102 can be a printed circuit board (PCB) configuration comprising the plurality of LEDs 112, 114 and the plurality of optical detectors 120. The control card 101 can also be a PCB configuration which comprises a plurality of different electronic components and connections as illustrated in FIG. 2. For example, the control card 101 comprises the LED driver units 116, the processing units 124, 126, the switching elements 130, 132, 134 and many other electronic components.

Figure 3:
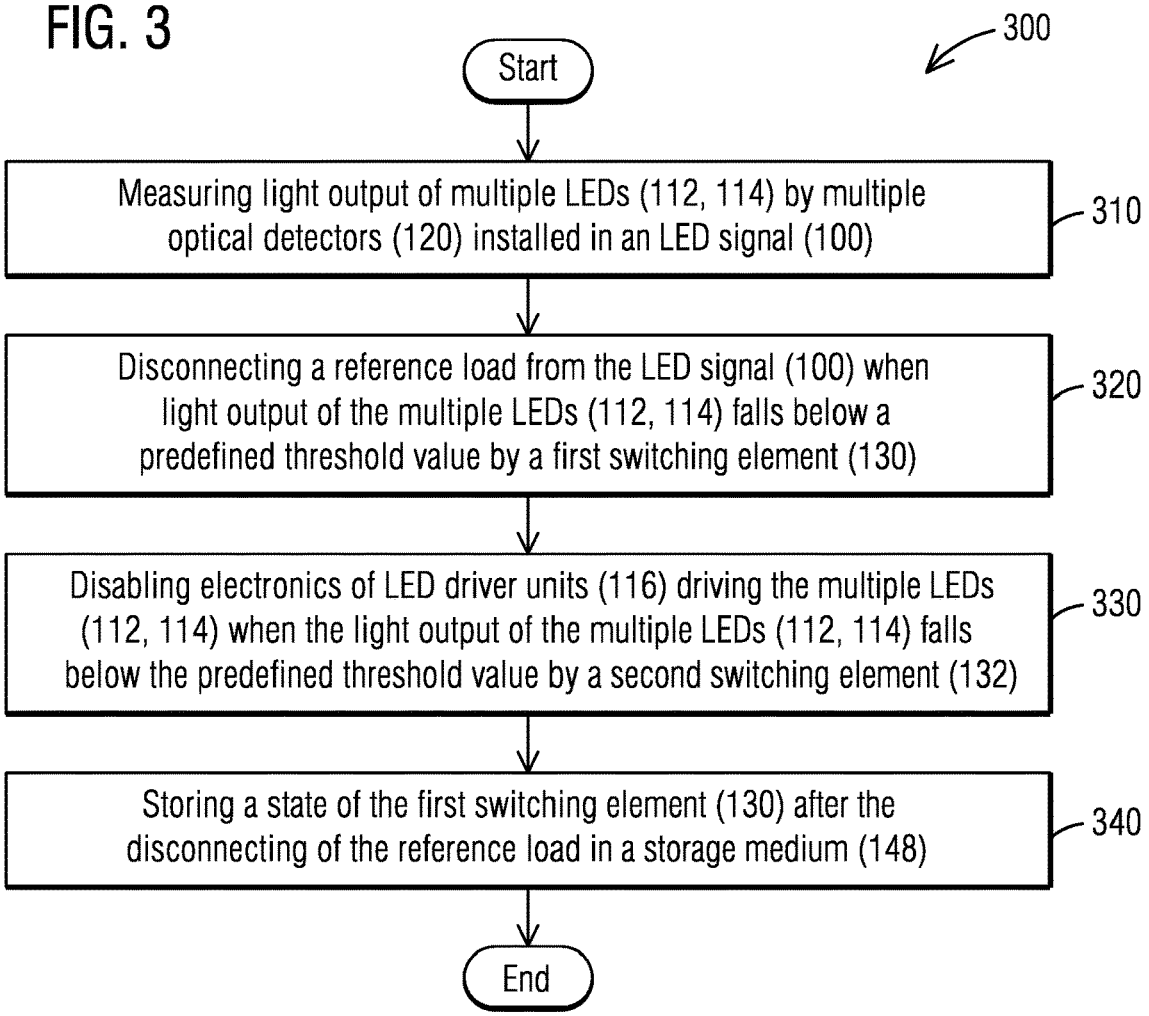
FIG. 3 illustrates a flow chart of a method for monitoring a light output of a wayside LED signal in accordance with an exemplary embodiment of the present invention.

FIG. 3 illustrates a flow chart of a method 300 for monitoring a light output of a LED signal 100 as previously described in FIGS. 1 and 2 in accordance with an exemplary embodiment of the present invention. In step 310, the light output of the multiple LEDs 112, 114 is measured (monitored) by multiple optical detectors 120 installed in the LED signal 100. In step 320, when the light output of the multiple LEDs 112, 114 falls below a predefined threshold value, a reference load 150 is disconnected by the first switching element 130. In step 330, when the light output of the multiple LEDs 112, 114 falls below the predefined threshold value, electronics of the LED driver units 116 driving the multiple LEDs 112, 114 are disabled by the second switching element 132. According to an exemplary embodiment, the disconnecting of the reference load 150 and the disabling of the electronics of the LED driver units 116 occurs simultaneously. After the disconnecting of the reference load 150, a current state of the first switching element 130 is stored in the storage medium 148, specifically a non-volatile or non-transitory memory (step 340).

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

The invention claimed is:

1. A monitoring system for light out detection for a light emitting diode (LED) signal comprising:

a plurality of optical detectors for measuring a light output of a plurality of light emitting diodes (LEDs);

a first processing unit in communication with the plurality of optical detectors and configured to receive and process measurement data of the light output from the plurality of optical detectors;

a second processing unit in communication with the plurality of optical detectors and configured to receive and process measurement data of the light output from the plurality of optical detectors; and a first switching element operably coupled to the first processing unit and the second processing unit, wherein the first and second processing units are arranged in parallel providing 2-out-of-2 logic for a disconnect of the reference load by the first switching element, wherein the first processing unit and the second processing unit are further configured to transmit respective control signals based on the measurement data of the light output of the plurality of LEDs to the first switching element to disconnect a reference load by switching from a first state to a second state when the light output is less than a predefined threshold value, and wherein the second state of the first switching element is stored in a storage medium.

2. The monitoring system as claimed in claim 1, further comprising:

a plurality of LED driver units for driving the plurality of LEDs; and a second switching element operably coupled to the first and second processing units and configured to disable electronics of the LED driver units based on control signals of at least one of the first and second processing units.

3. The monitoring system as claimed in claim 2, wherein the second switching element disables the electronics of the LED driver units by switching from a first state to a second state when the light output of the plurality of LEDs is less than a predefined threshold value, and wherein the second state of the second switching element is stored in the storage medium.

4. The monitoring system as claimed in claim 1, wherein the predefined threshold value is based on a rated light output of the plurality of LEDs.

5. The monitoring system as claimed in claim 1, wherein the plurality of optical detectors is selected from the group consisting of a photodiode, a phototransistor, a photo-resistor, light-dependent resistor, a photocell, and a combination thereof.

6. The monitoring system as claimed in claim 1, wherein the storage medium comprises a non-volatile memory and is integrated in the first processing unit and/or the second processing unit.

7. The monitoring system as claimed in claim 1, further comprising:

a power source; and a third switching element operably coupled to the first and second processing units and configured to disconnect the power source based on control signals of at least one of the first and second processing units.

8. A light emitting diode (LED) signal comprising:

an arrangement of multiple LEDs and multiple LED driver units for driving the multiple LEDs; and a monitoring system comprising multiple optical detectors arranged to detect and monitor light output of the multiple LEDs, at least two processing units configured to receive and process measurement data of the multiple optical detectors, and at least one switching element coupled to the at least two processing units, wherein the at least two processing units are arranged in parallel providing 2-out-of-2 logic for a disconnect of a reference load by the first switching element, wherein the at least two processing units are further configured to transmit a control signal based on the measurement data of the light output to the first switching element to disconnect the reference load by switching from a first state to a second state when the light output of the multiple LEDs is less than a predefined threshold value, and wherein the second state of the first switching element is stored in a non-volatile storage medium.

9. The LED signal as claimed in claim 8, further comprising:

a second switching element coupled to the at least two processing units, wherein the at least two processing units are further configured to transmit a control signal to the second switching element to disable electronics of the multiple LED driver units when the light output of the multiple LEDs is less than the predefined threshold value, wherein the second switching element is configured to disable the electronics of the LED driver units based on respective control signals of any one of the at least two processing units.

10. The LED signal as claimed in claim 8, wherein the predefined threshold value is based on a rated light output of the multiple LEDs, and wherein the first switching element disconnects the reference load when the light output is less than 50% of the rated light output of the multiple LEDs.

11. The LED signal as claimed in claim 8, further comprising:

a power source; and a third switching element, wherein the third switching element disconnects the power source when a supplied power of the power source is below a predefined threshold value based on control signals supplied by any one of the at least two processing units.

12. The LED signal as claimed in claim 8, wherein the storage medium is integrated in any one of the at least two processing units.

13. A method for monitoring a light output of a light emitting diode (LED) signal comprising:

measuring light output of multiple LEDs by multiple optical detectors installed in the LED signal;

receiving, by a first processing unit and a second processing unit, measured light output of the multiple LEDs;

transmitting, by the first processing unit and/or the second processing unit, a control signal to disconnect a reference load from the LED signal based on the measured light output;

disconnecting the reference load from the LED signal when the light output of the multiple LEDs falls below a predefined threshold value by a first switching element, wherein the first switching element disconnects the reference load based on the control signal from any one of the first and second processing units; and storing a state of the first switching element after the disconnecting of the reference load in a storage medium.

14. The method as claimed in claim 13, wherein the disconnecting of the reference load occurs when the light output of the multiple LEDs is less than 50% of a rated light output of the multiple LEDs.

15. The method as claimed in claim 13, further comprising:

disabling electronics of LED driver units driving the multiple LEDs when the light output of the multiple LEDs falls below the predefined threshold value by a second switching element, wherein the second switching element disables the electronics of the LED driver units based on a control signal from any one of the first and second processing units.

16. The method as claimed in claim 13, wherein the disconnecting of the reference load and the disabling of the electronics of the LED driver units occurs simultaneously.

17. The method as claimed in claim 13, wherein the first and second processing units are arranged in parallel and provide 2-out-of-2 logic for the disconnecting of the reference load and the disabling of the electronics of the LED driver units.

* * * * *